United States Patent [19]

Violette

[11] Patent Number: 4,836,432

[45] Date of Patent: Jun. 6, 1989

[54] HOSE GUIDE

[76] Inventor: Nelson R. Violette, 1845 SW. 3rd Ave., Fort Lauderdale, Fla. 33315

[21] Appl. No.: 135,074

[22] Filed: Dec. 18, 1987

[51] Int. Cl.[4] ..... B05C 11/00

[52] U.S. Cl. ..... 226/196; 226/198; 137/377

[58] Field of Search ..... 226/196–199; 137/377

[56] References Cited

U.S. PATENT DOCUMENTS

| | | | |
|---|---|---|---|
| 2,603,432 | 7/1952 | Paulsen | 226/197 |
| 2,814,460 | 11/1957 | Marcolango | 226/197 |
| 3,097,827 | 7/1963 | McDaniel | 226/197 |
| 4,404,925 | 9/1983 | Louwsma | 137/377 X |

*Primary Examiner*—Stuart S. Levy
*Assistant Examiner*—Steven M. DuBois
*Attorney, Agent, or Firm*—Oltman and Flynn

[57] ABSTRACT

A hose guide for preventing a hose from getting caught under the tire of an automotive vehicle. The hose guide is a generally U-shaped body with flexible and resilient, opposite, longitudinal legs that grip a tire between them. The hose guide body is concave in vertical cross-section on the outside along the bight segment of the "U" and along the opposite legs of the "U" away from the bight. The hose guide body has a horizontally elongated opening in its bight segment just below the top to form a handle. The hose guide body is wide enough on the bottom that it cannot be tipped over easily.

10 Claims, 2 Drawing Sheets

FIG. 1
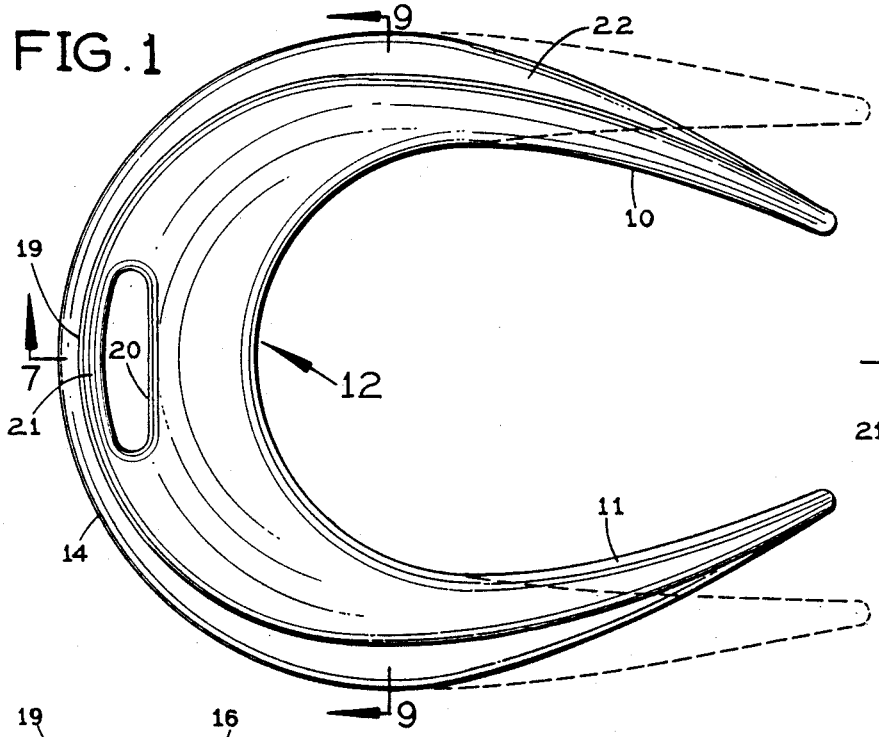
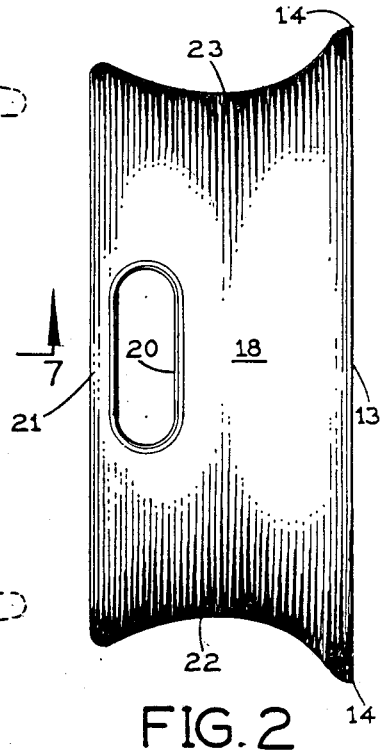
FIG. 2
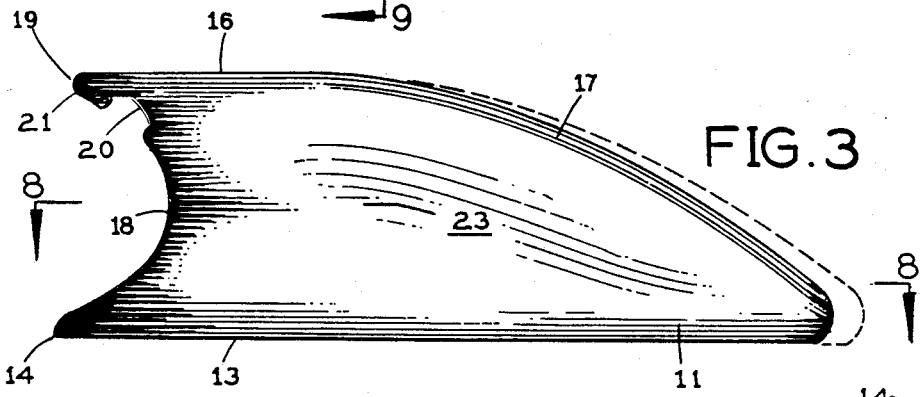
FIG. 3
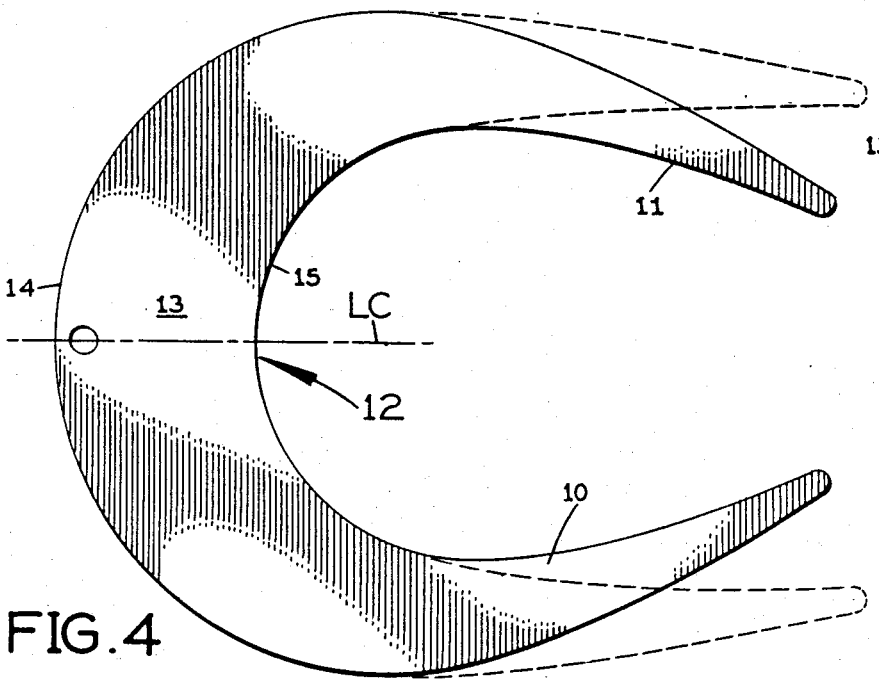
FIG. 4
FIG. 5
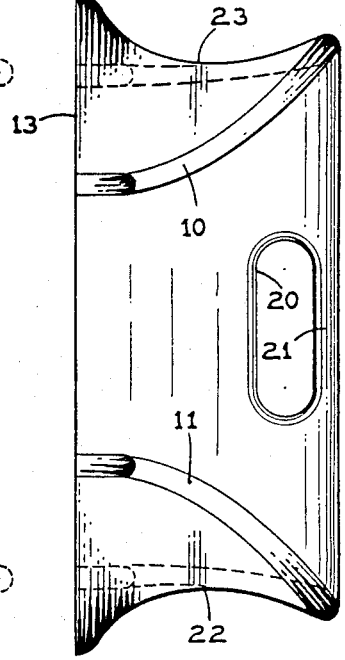

FIG. 6
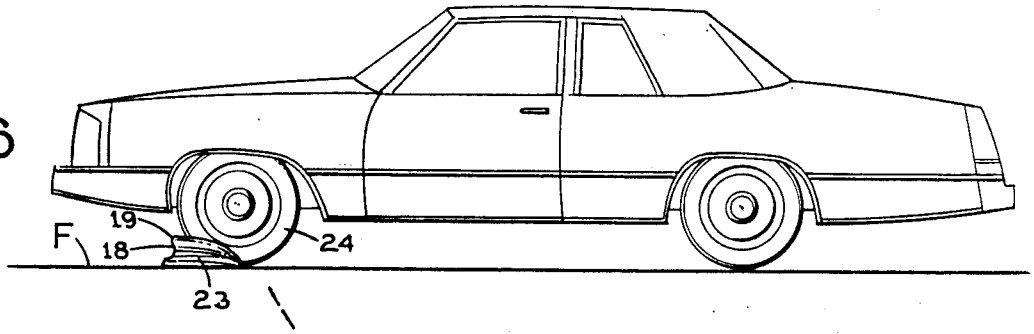
FIG. 7
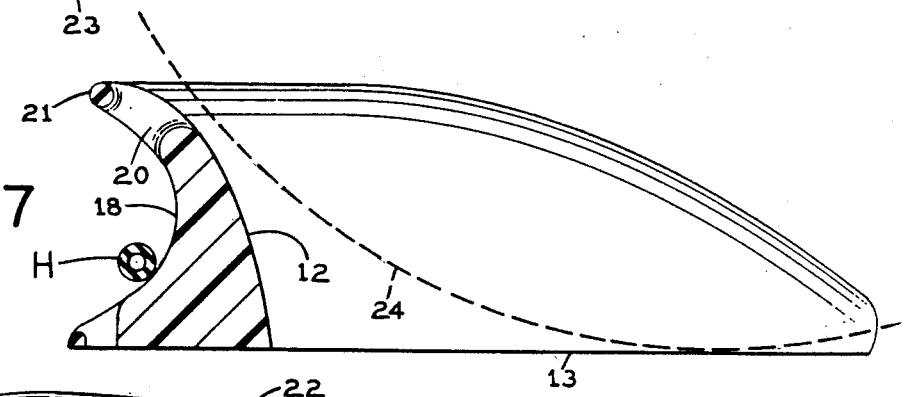
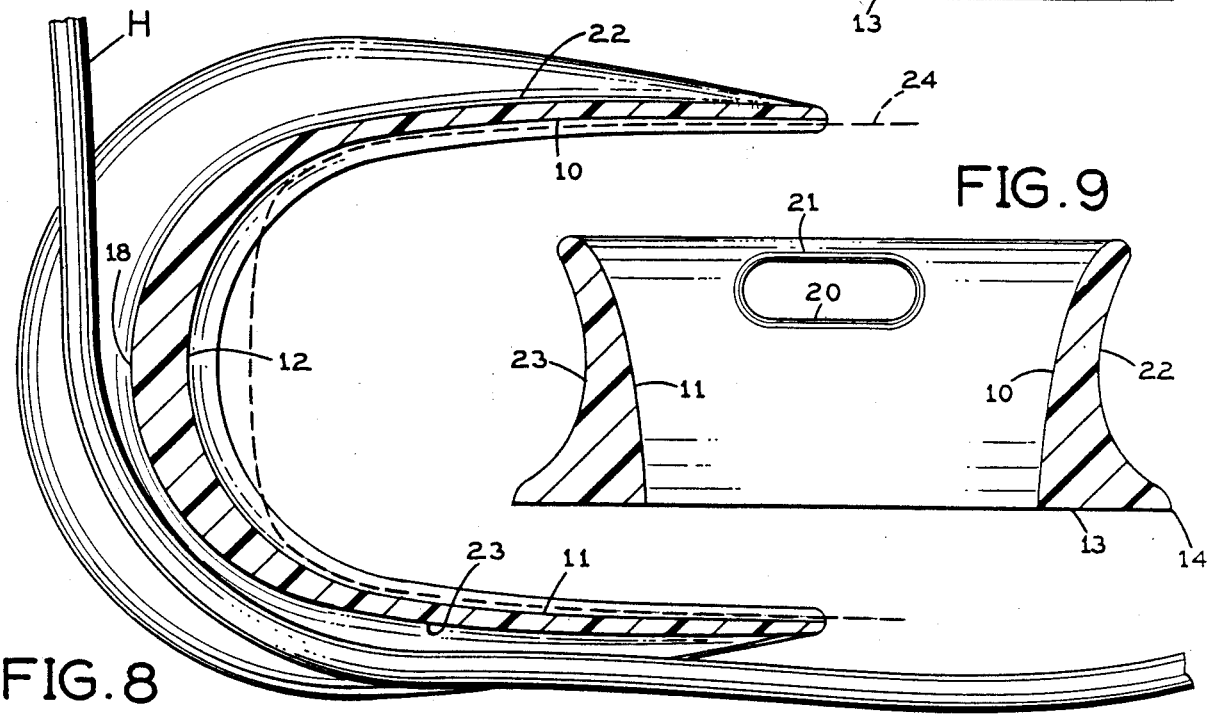
FIG. 8
FIG. 9
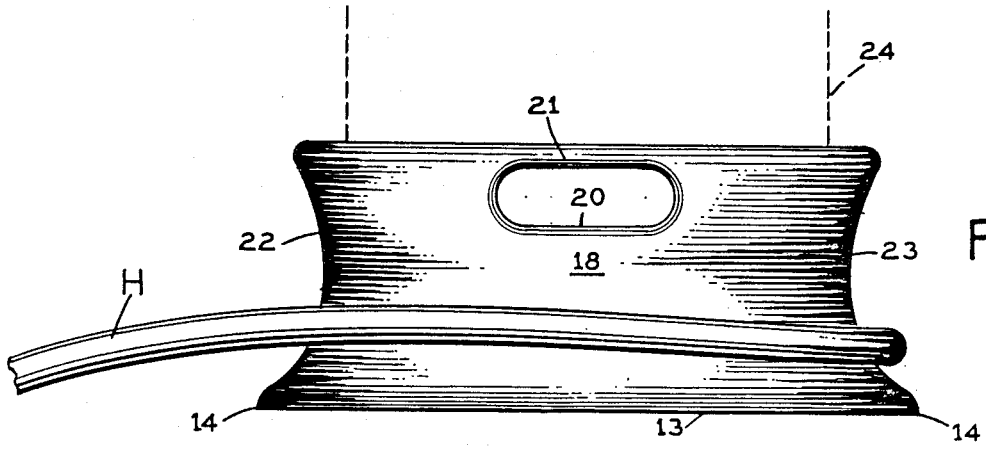
FIG. 10

HOSE GUIDE

SUMMARY OF THE INVENTION

This invention relates to a hose guide for use with a wheeled vehicle to prevent a hose, such as a spray paint hose or a water hose, from getting caught under a tire when the vehicle is being spray-painted or washed.

One of the aggravating problems in spray-painting or washing a rubber-tired vehicle is the tendency of the paint hose or water hose to get caught under one of the vehicle tires, usually a front tire, as the person using the hose proceeds away from that end of the car being spray-painted or washed. The present invention is directed to a novel solution to this problem.

In accordance with the present invention, a novel hose guide is provided which fits across the front of a front tire or the back of a rear tire on the vehicle to prevent the hose from getting caught under that tire. The hose guide has a smooth concave surface on the outside across which the hose slides easily when pulled, so that the user can proceed to spray-paint or wash the vehicle without worrying that the hose will get caught or impeded when pulled.

A principal object of this invention is to provide a novel hose guide for use with a wheeled vehicle to prevent a hose from getting caught under a tire on the vehicle.

Preferably, the present hose guide is a generally U-shaped body which straddles the vehicle tire at the support surface for the vehicle, such as a driveway or the floor of a vehicle paint shop. The U-shaped body has a curved bight segment connecting opposite flexible and resilient legs which resiliently grip the outside and inside faces of the tire. This bight segment is concave on the outside, as are the opposite legs of the hose guide body, to slidably receive and guide a hose that is being pulled. The bight segment has a horizontally elongated, oblong opening near the top which is wide enough to receive all the fingers of a person's hand, providing a handle at the top that may be grasped by that hand when the hose guide body is to be positioned at a vehicle wheel or moved away from it.

Further objects and advantages of this invention will be apparent from the following detailed description of a presently preferred embodiment shown in the accompanying drawings.

DESCRIPTION OF THE DRAWINGS

FIG. 1 is a top plan view of the present hose guide with its opposite legs shown in their undeformed positions in full lines and spread apart in phantom;

FIG. 2 is a front elevation;

FIG. 3 is a right side elevation;

FIG. 4 is a bottom plan view;

FIG. 5 is a rear elevation;

FIG. 6 shows the present hose guide straddling and gripping one of the front tires on an automobile that is to be washed or spray painted;

FIG. 7 is a longitudinal vertical section taken along the centerline 7—7 in FIG. 1 and showing a hose engaging the outside of the present hose guide;

FIG. 8 is a longitudinal horizontal section taken along the line 8—8 in FIG. 3 and showing the hose extending along the outside of the hose guide;

FIG. 9 is a vertical cross-section taken along the line 9—9 in FIG. 1; and FIG. 10 is a front elevation showing the hose extending across the hose guide.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Referring to FIGS. 1 and 4, viewed from above or below, the present hose guide is a generally U-shaped body having opposite longitudinal legs 10 and 11 connected at one end by an arcuate bight segment 12. The opposite legs 10 and 11 are inclined toward each other in a direction away from the bight segment 12, as shown in full lines in FIG. 1. The entire hose guide body is a one-piece molded body of suitable plastic. The opposite legs 10 and 11 are flexible and resilient so that they can be spread apart to extend substantially parallel, as shown in phantom in FIG. 1. In this spread-apart condition they resiliently grip the outside and inside faces of a vehicle tire. In one practical embodiment in the undeformed condition shown in full lines in FIG. 1, the maximum distance between the legs 10 and 11 is eight inches and the minimum distance between them (at their free ends away from bight segment 12) is five inches.

For convenience of description, the bight segment 12 will be referred to occasionally as the "front end" of the hose guide body. Throughout its extent the hose guide body presents a flat horizontal bottom face 13 which, as shown in FIG. 4, has is maximum width between the outer and inner edges 14 and 15 of the "U" at the middle of the bight segment 12 (along the longitudinal centerline LC of the body, FIG. 4) and is of gradually diminishing width along the opposite legs 10 and 11 away from the bight segment. Referring to FIG. 3, at the top the hose guide body presents a horizontal flat surface 16 along its bight segment 12 and a downwardly and rearwardly inclined surface 17 along each of its opposite legs 10 and 11. Thus, the hose guide body has its maximum height (up from its bottom face 13) at its bight segment 12 and a gradually diminishing height along each leg 10 and 11 in a direction away from the bight segment.

As shown by FIGS. 3 and 4, the width of the hose guide body on its bottom face 13 between its outer edge 14 and its inner edge 15 (FIG. 4) over its entire curved bight segment 12 at the front end is a substantial fraction of its height thereat up from its bottom face. Likewise, along each of its opposite straight legs 10 and 11 the hose guide body has a width on the bottom between its outer and inner edges which is at least a substantial fraction of its height at any point rearward from the bight segment 12. As shown by FIGS. 7, 8 and 9, the hose guide body has its maximum horizontal thickness on the bottom and a diminishing horizontal thickness upward from the bottom in its bight segment 12 and also in each opposite leg 10 and 11. Consequently, the hose guide body has a low center of gravity and a broad enough surface area along the bottom that it has a stable position on the floor of the paint area in an automotive body shop or paint shop or on a driveway or other place where the vehicle would be washed, and it is not readily susceptible to being tipped over.

As shown in FIG. 3, at its bight segment 12 the front outside face 18 of the hose guide body is concave vertically, curving upwardly and rearwardly from its bottom outside front edge 14 and then curving upwardly and forwardly to a rounded top outside front edge 19. Just above its bottom edge 14 the front outside surface of the hose guide body tapers upward and rearward to guide a hose up from the floor or driveway onto the concave surface 18 when a pull is exerted on the hose.

At this front face near the top the hose guide body is formed with an oblong opening 20 (FIGS. 1 and 2), which is open at the front and at the top of its bight segment 12, as best seen in FIG. 7. As shown in FIGS. 1 and 2, this opening is elongated horizontally on opposite sides of the longitudinal centerline LC. All the fingers of a person's hand can be inserted into the opening so that the top front part 21 of the bight segment 12 between this opening and the top front edge 19 provides a handle that may be grasped by a person's hand.

Along each of its opposite longitudinal legs 10 and 11 the outside face of the hose guide body is concave vertically, providing a smooth continuation of the concave outside surface 18 on its front end. The concave outside surface of leg 10 is shown at 22 in FIGS. 1, 2 and 5, and the concave outside surface of leg 11 is shown at 23. Rearward along each leg 10 and 11 of the hose guide from the cross-section line 9—9 in FIG. 1, the concave outside surface 22 or 23 inclines downward toward the bottom face 13 because of the gradually diminishing height of the hose guide rearward. Because of this, a hose being pulled across the outside of the bight segment 12 and then rearward along either leg 10 or 11 passes from engagement with that leg just above the floor or other support surface, so there is no abrupt discontinuity or change in the hose's position where it engages the floor.

The present hose guide typically is used as shown in FIG. 6, positioned on the floor or driveway F to straddle the front tire 24 of a vehicle, with the bight segment 12 of the hose guide extending in front of the tire 24 as shown in FIG. 7 and the opposite legs 10 and 11 of the hose guide spread apart by the tire and resiliently gripping its opposite faces. It will be apparent that the hose guide prevents a spray paint hose or water hose H (FIG. 8) from getting caught under the front tire when the user pulls the hose toward the back of the vehicle, as typically happens during spray painting or washing the vehicle.

It is to be understood that two of the present hose guides are used, preferably, one at each front wheel. If desired, there may be two at the front wheels and two just behind the rear wheels of the vehicle.

I claim:

1. A hose guide for use with an automotive vehicle paint spray apparatus, said guide comprising a generally U-shaped body having a substantially flat bottom for engagement with a support surface for the vehicle and having opposite longitudinal legs and a curved bight segment connecting said opposite legs at one end of the body, said body being open from bottom to top at the inside of the "U" between said opposite legs for the entire length of said legs, said body being constructed to receive the tire of an automotive vehicle on the inside of the "U" between said opposite legs, said body being concave upward from said bottom on the outside of said bight segment of the "U" for slidably guiding the hose thereat;

said opposite legs being inclined toward each other along said body in a direction away from said bight segment, and said opposite legs being flexible and resilient to resiliently grip a vehicle tire between them.

2. A hose guide according to claim 1 wherein said bight segment has a horizontally elongated opening near the top wide enough to receive all the fingers of a person's hand and providing a handle on the top of said bight segment.

3. A hose guide according to claim 1 wherein said body is concave upward from said bottom on the outside of both said opposite legs for slidably guiding the hose at either of said legs.

4. A hose guide according to claim 3 wherein said bight segment has a horizontally elongated opening a short distance below the top that is wide enough to pass all the fingers of a person's hand and provide a handle on the top of said bight segment.

5. A hose guide according to claim 4 wherein said body on the bottom of its bight segment has a width between its outside and inside edges which is at least a substantial fraction of its height.

6. A hose guide according to claim 5 wherein said body on the bottom has a diminishing width between its outside and inside edges along each of said opposite legs away from said bight segment.

7. A hose guide according to claim 3 wherein the concave outside surface of each of said legs is inclined downward along said leg toward the rear end of said leg away from said bight segment.

8. A hose guide according to claim 7 wherein said generally U-shaped body has a width on the bottom between its outside and inside edges at said bight segment which is at least a substantial fraction of its height up from said bottom.

9. A hose guide according to claim 8 wherein said body on the bottom has a diminishing width between its outside and inside edges rearward along each of said opposite legs away from said bight segment.

10. A hose guide according to claim 9 wherein said bight segment has a horizontally elongated opening a short distance below the top that is wide enough to pass all the fingers of a person's hand and provide a handle on the top of said bight segment.

* * * * *